US007143628B2

(12) United States Patent
Hess et al.

(10) Patent No.: US 7,143,628 B2
(45) **Date of Patent: *Dec. 5, 2006**

(54) MULTIPLE MOVABLE CARRIAGES WITH MULTI-RADIUS TRACKS AND TILTED ROLLERS

(75) Inventors: Jeffery A. Hess, Grand Island, NE (US); Daniel R. McClellan, Grand Island, NE (US); Jeffrey L. Dobbins, Grand Island, NE (US); Dean L. Mish, Potosi, WI (US); Adam J. Koehler, Dubuque, IA (US)

(73) Assignee: Delaware Capital Formation Inc, Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/171,053

(22) Filed: Jun. 30, 2005

(65) Prior Publication Data

US 2005/0235731 A1 Oct. 27, 2005

Related U.S. Application Data

(63) Continuation of application No. 10/855,285, filed on May 27, 2004, now Pat. No. 6,925,848.

(60) Provisional application No. 60/474,309, filed on May 30, 2003.

(51) Int. Cl.
*B21D 1/12* (2006.01)

(52) U.S. Cl. ..... 72/447; 72/705

(58) Field of Classification Search ..... 72/308, 72/447, 457, 705

See application file for complete search history.

(56) References Cited

U.S. PATENT DOCUMENTS

| | | | |
|---|---|---|---|
| 3,888,100 | A | 6/1975 | Chisum |
| 4,088,006 | A | 5/1978 | Patten |
| 4,313,335 | A | 2/1982 | Eck |
| 4,398,410 | A | 8/1983 | McWhorter |
| 4,520,649 | A | 6/1985 | Barton |
| 4,530,232 | A | 7/1985 | Smith |
| 4,794,783 | A | 1/1989 | Eck |
| 4,823,589 | A | 4/1989 | Maxwell |
| 4,932,236 | A | 6/1990 | Hinson |
| 4,986,107 | A | 1/1991 | Peyret |
| 5,016,464 | A | 5/1991 | Tomelleri |
| 5,027,639 | A | 7/1991 | Hinson |
| 5,111,680 | A | 5/1992 | Ballard |
| 5,131,257 | A | 7/1992 | Mingardi |
| 5,189,899 | A | 3/1993 | Hsu |
| 5,199,289 | A | 4/1993 | Hinson |
| 5,263,357 | A | 11/1993 | Dumais |
| 5,317,891 | A | 6/1994 | Ballard |

(Continued)

FOREIGN PATENT DOCUMENTS

DE 42 29 501 A1 3/1994

(Continued)

*Primary Examiner*—Lowell A. Larson
(74) *Attorney, Agent, or Firm*—Spencer Fane Britt & Browne

(57) ABSTRACT

A vehicle straightening bench having a work platform with an inner track and an outer track. The platform has side edges and end edges with curved corners therebetween. A pulling tower assembly is movably mounted to the inner and outer tracks via a carriage having a generally triangular shaped wheel arrangement.

26 Claims, 13 Drawing Sheets

U.S. PATENT DOCUMENTS

| | | | |
|---|---|---|---|
| 5,355,711 | A | 10/1994 | Chisum |
| 5,596,900 | A | 1/1997 | Pietrelli |
| 5,623,846 | A | 4/1997 | Brewer |
| 5,640,878 | A | 6/1997 | Hinson |
| 5,794,511 | A | 8/1998 | Sorbel |
| 5,918,500 | A | 7/1999 | Brewer |
| 5,931,043 | A | 8/1999 | Liegel |

FOREIGN PATENT DOCUMENTS

| | | | |
|---|---|---|---|
| DE | 196 12 852 | A1 | 10/1997 |
| EP | 0 282 176 | A2 | 7/1988 |
| EP | 1 106 273 | A2 | 6/2001 |
| FR | 2 246 322 | | 5/1975 |

MULTIPLE MOVABLE CARRIAGES WITH MULTI-RADIUS TRACKS AND TILTED ROLLERS

CROSS REFERENCE TO RELATED APPLICATION

This application is a continuation of and claims priority to application Ser. No. 10/855,285, filed on May 27, 2004, now U.S. Pat. No. 6,925,848, which claims priority to U.S. Provisional Patent Application Ser. No. 60/474,309 filed May 30, 2003. application Ser. No. 10/855,285 is hereby incorporated herein by reference.

BACKGROUND OF THE INVENTION

This invention relates to an apparatus used to straighten vehicle chassis. More particularly, the invention relates to straightening benches having multi-radius corners for guiding multiple movable carriages along tracks mounted on the benches. The moveable carriages are supported and guided along the tracks by rollers.

Occasionally, vehicles are involved in collisions, and before they can reenter meaningful service, the vehicle chassis must be returned, as nearly as possible, to their original configurations. This is frequently accomplished with straightening benches. A typical straightening bench includes a platform for supporting and anchoring a vehicle chassis while forces are applied to the chassis by pulling assemblies. The pulling assemblies utilize hydraulically powered telescoping towers with chains that attach to desired locations on the vehicle chassis. To hold them in place, the pulling assemblies are secured on the underside of the platform while force is applied to the chassis. In many designs the pulling assemblies are permanently mounted to the bottom side of the platform. With the pulling assemblies mounted on the platform, the large hydraulic pulling forces exerted by the towers create even larger moments and forces where the pulling assemblies are mounted to the platform. Thus, the pulling assembly mounts must be excessively over designed and occasionally fail rendering the pulling assembly inoperable. Further, the pulling assembly mounts unduly limit the possible positions of the pulling assemblies and hence restrict an operator's ability to apply force in any desired direction.

DESCRIPTION OF THE INVENTION

There is therefore provided in the practice of the invention a novel vehicle-straightening bench which provides increased versatility, improved force control, and enhanced safety, for straightening vehicle chassis by the application of hydraulic force to the vehicle chassis. The vehicle bench broadly includes a vehicle platform operable to support a vehicle chassis. A pulling tower is provided to apply force to the vehicle chassis. An arm assembly is moveably received by a carriage track, which is mounted on the platform, and the pulling tower is mounted on the arm assembly to provide a pulling assembly.

In a preferred embodiment, the pulling tower is mounted on the arm assembly, and the arm assembly includes a tower positioning mechanism. The tower positioning mechanism engages a tower. The arm assembly mounts the pulling tower to the platform. The pulling tower is substantially perpendicular to the bench while the pulling tower and arm assembly are moved along the carriage track and during pulls.

A preferred arm assembly includes a generally trapezoidal arm body having an inwardly facing narrow end and an outwardly facing wide end. An inner wheel assembly is mounted on the narrow end of the arm body for engaging the platform adjacent an inner rail of the carriage track. Two outer wheels with an axial angle are supported on an outer rail of the carriage track. The outer wheels preferably include channels, which engage the outer rail on two perpendicular surfaces. Preferably, the arm assembly alone supports the pulling tower above the ground surface.

A preferred carriage track has curves with multiple radii to allow continuous contact of the wheels with the rails as the pulling assembly is moved around the track.

Accordingly, it is an object of the present invention to provide an improved vehicle-straightening bench for straightening vehicle chassis.

It is another object of the present invention to provide an improved arm assembly for movement and increased positioning versatility of pulling towers around a vehicle-straightening bench.

It is a further object of the present invention to provide a multi-radius track for improved movement around the carriage track.

BRIEF DESCRIPTION OF THE DRAWINGS

These and other inventive features, advantages, and objects will appear from the following Detailed Description when considered in connection with the accompanying drawings in which similar reference characters denote similar elements throughout the several views and wherein.

DETAILED DESCRIPTION

Figure 1A:
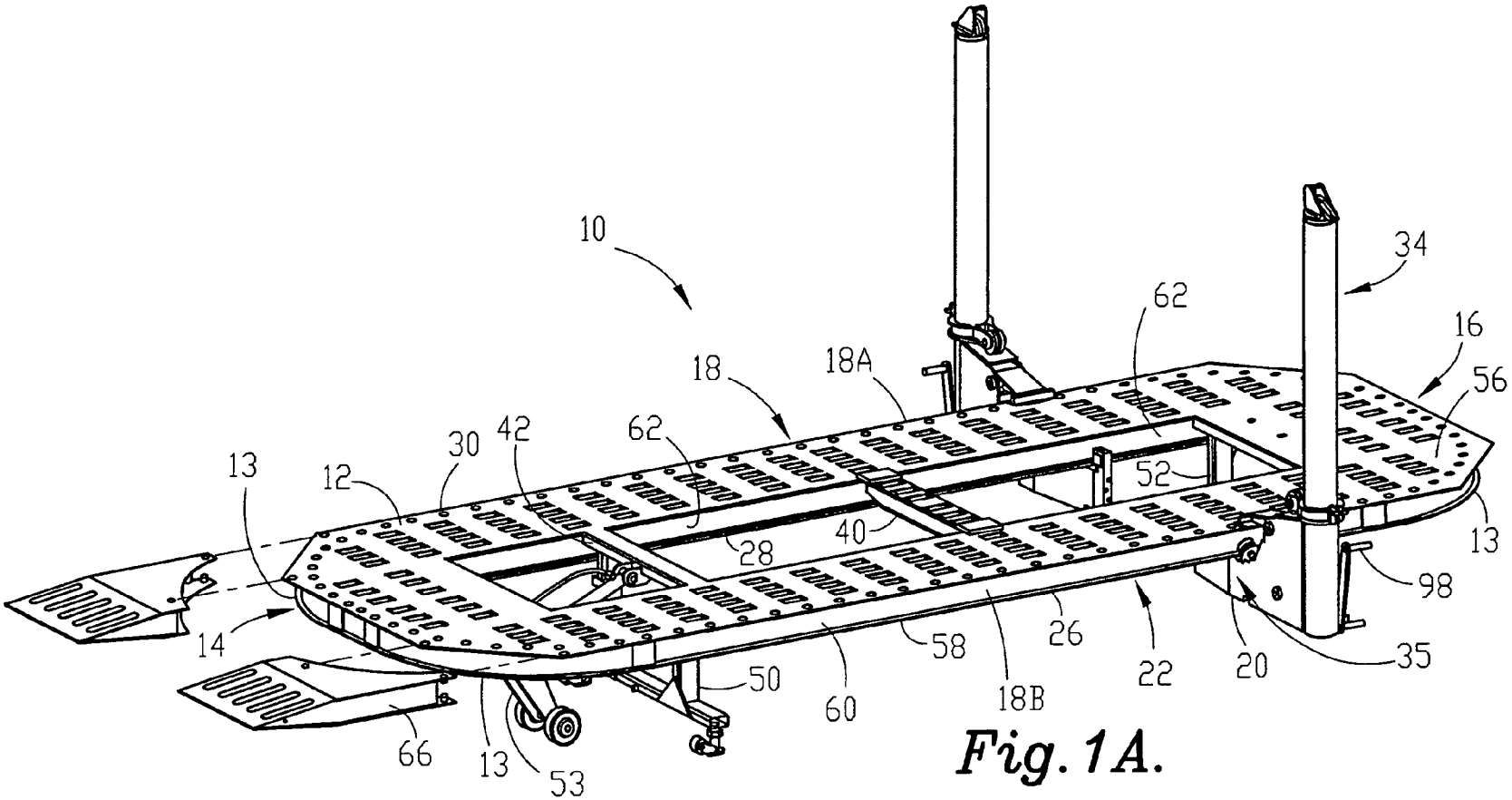
FIG. 1A is a perspective view of a vehicle-straightening bench according to the present invention and including a plurality of arm assemblies and pulling assemblies.
Figure 1B:
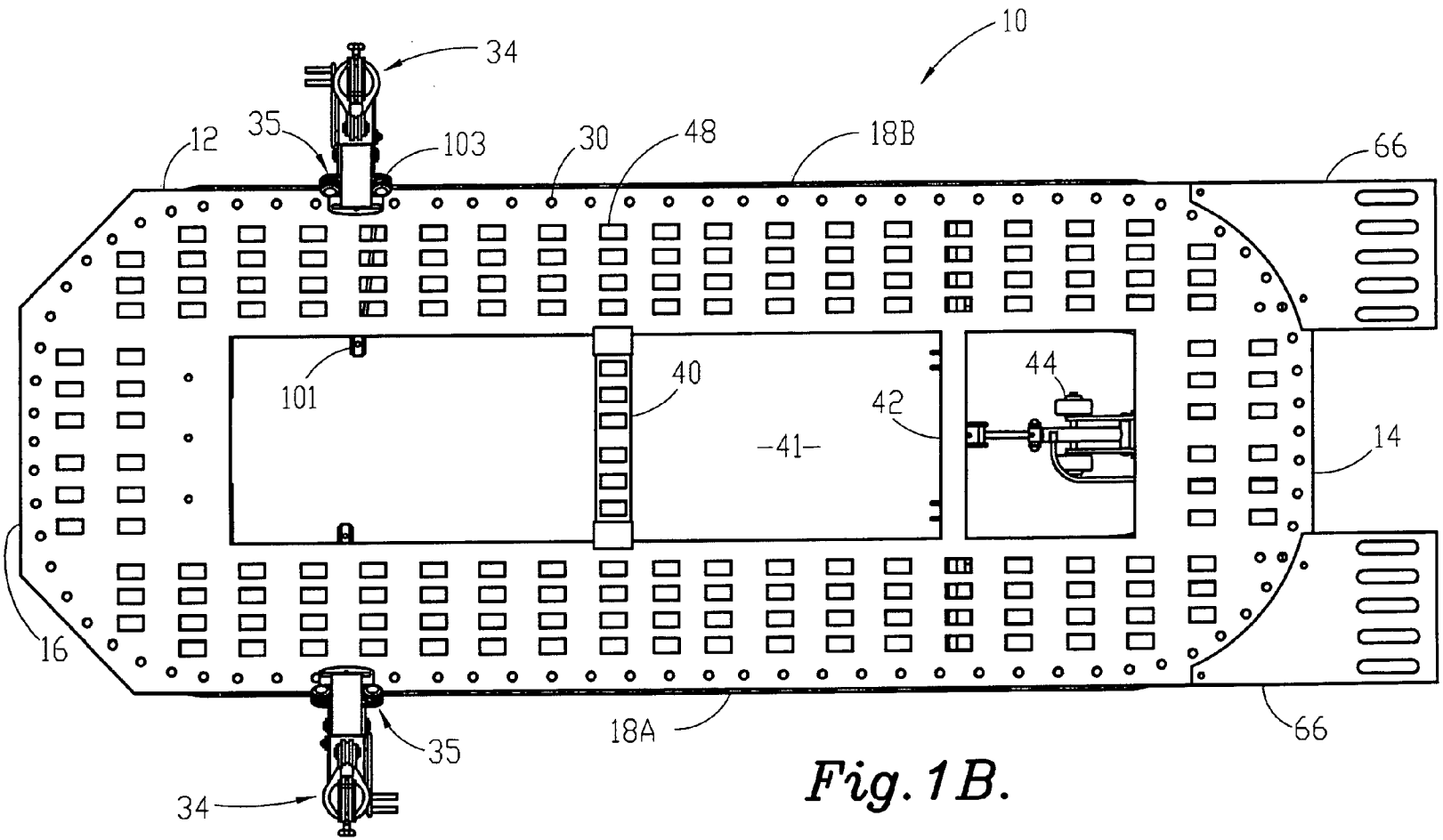
FIG. 1B is a top view of the bench of FIG. 1A.
Figure 1C:
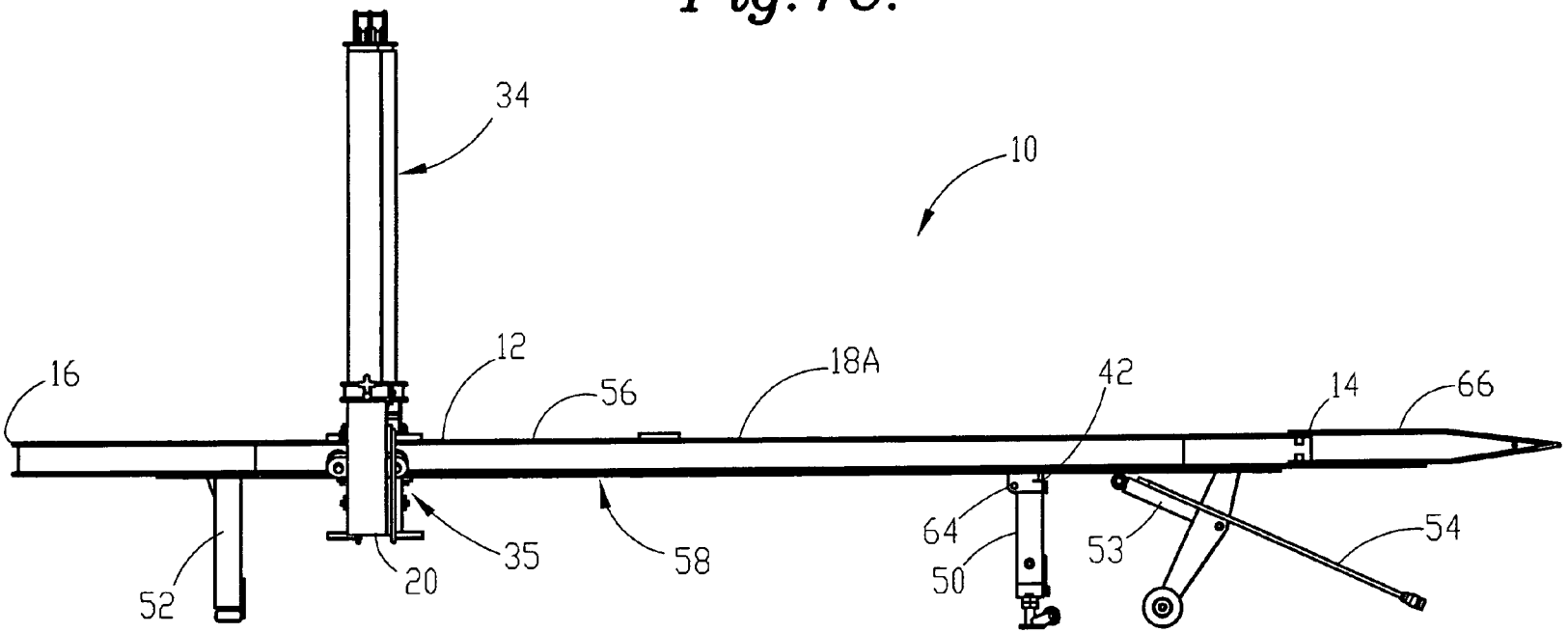
FIG. 1C is a side view of the bench of FIG. 1A.

Referring to the drawings in greater detail, FIGS. 1A–1C show a vehicle straightening bench 10 constructed in accordance with a preferred embodiment of the present invention. The bench 10 broadly includes a vehicle platform 12 providing a carriage track 22, a plurality of pulling assemblies 34, each having an arm assembly 20 mounted to the platform 12 and moveably received by the carriage track 22 via wheeled carriage assemblies 35. The platform has generally opposed sides 18A, B and ends 14, 16 connected by corners 13 extending between the sides and ends. The vehicle platform 12 is operable to support a vehicle chassis (not shown), and a plurality of anchors (not shown). The anchors are positioned and fixed at different locations on the platform 12 in any number of the anchor apertures 48. The anchors attach to the vehicle chassis at selected locations holding the vehicle in a substantially fixed position relative to the platform 12. The straightening bench 10 also includes a pair of ramps 66, which are removably connected to the platform 12. The ramps 66 are invertable and reversible. While the vehicle chassis is secured, the pulling assemblies 34 can be moved to desired locations around the bench 10 and locked in position. The pulling assemblies 34 then apply force to the vehicle chassis at desired locations and in desired directions. The arm assemblies 20 are substantially identical and the pulling assemblies 34 are substantially identical, and they will be described in the singular at times for clarity with the understanding that the description applies to all of the respective assemblies.

The vehicle platform 12 is substantially rigid and includes an upper deck 56 defining a top of the platform and a lower deck 58 defining a bottom of the platform. The upper and lower decks 56, 58 are joined by an outer wall plate 60 and inner wall plate 62. The carriage track 22 is formed by portions of the deck 58 and projects away from the walls 60, 62. A more detailed discussion of the carriage track 22 will follow with reference to FIGS. 3 and 10.

The platform 12 is supported by front legs 52 and rear legs 50. The rear legs 50 are pivotly anchored to a rear crossbeam 42. Cross beam 42 is fixedly attached to the upper deck 56 and provides an aperture on its under side, into which rear legs 50 are spring loadedly hinged at pivot pin 64. The platform 12 is preferably raised and lowered by a standard hydraulic lift 53 connected to a source of pressurized hydraulic fluid by hose 54. The lift 53 is preferably located at the rear 14 of the bench 10. The lift 53 is aligned with the rear crossbeam 42.

In operation, as the rear portion of the platform 12 is being raised, the leg 50 is forced from a retracted position toward a deployed vertical position by a spring and eventually is forced into a locked vertical position. The platform can then be lowered to fully rest on the leg 50. To lower the platform 12, the lift 53 raises the platform 12 enough to allow the legs 50 to be folded underneath the platform. The platform 12 can then be lowered while moving the legs 50 back to their retracted position.

The upper deck 56 defines a plurality of spaced anchoring apertures 48. The anchoring apertures 48 are preferably rectangular and are configured to receive components of an anchor (not shown). The upper deck 56 also defines a plurality of lock pin apertures 30, which are substantially uniformly spaced along a length and radius that follows the perimeter of the outside rail 26 of the carriage track 22.

Figure 2:
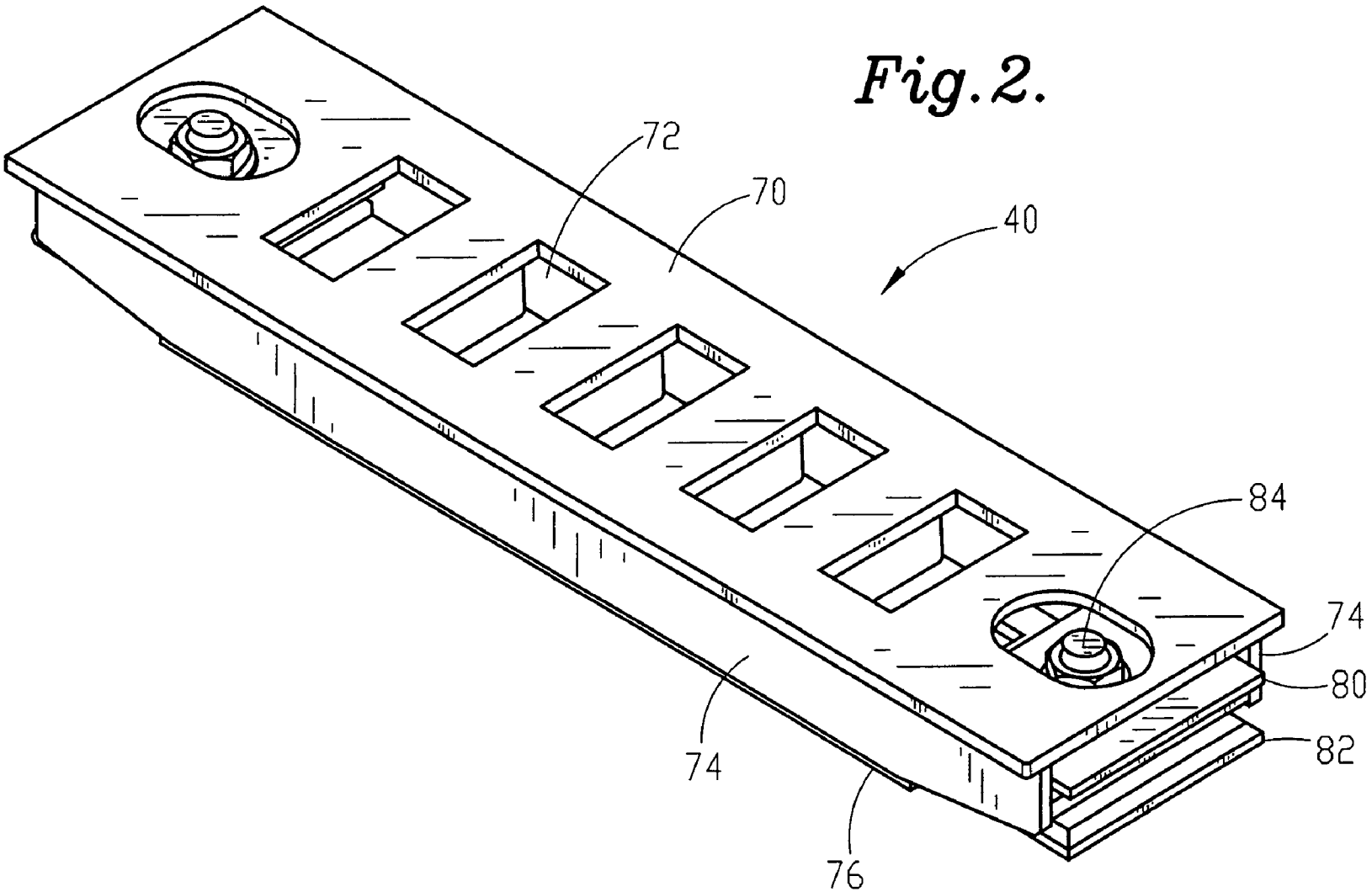
FIG. 2 is a perspective view of a moveable cross member.

The bench 10 also provides a moveable cross-member 40 illustrated in FIG. 2. The cross member 40 is selectively mountable to the upper deck 56 extending across the opening 41 of the platform 12. It may be positioned under a vehicle to assist in providing generally perpendicular or vertical pulls or pushes to a vehicle. The moveable cross-member 40 includes an upper plate 70, a lower plate 76 and side plates 74. The upper and lower plates 70, 76 define additional anchoring apertures 72. The distal ends of the cross-member 40 are each provided with a spacer plate (not shown) that provides a separation between a first slide bar 80 and a second slide bar 82. The slide bars 80, 82 protrude outwardly beyond the spacer plate (not shown) creating a channel to receive a bar welded to the inside vertical wall. A slide fastener 84 is provided to enable the slide bars 80, 82 to be slid into and out of the cavity formed by the plates, 70, 74 and 76, thus allowing the cross-member to be removed from bench 10. The slide fastener 84 also secures the slide bars in place when the cross member is the located between the bench sides 18. The lower plate 76 is beveled on each distal end such that spacing between the upper plate 70 and lower plate 76 is smaller on the distal ends of the cross-member 40 than in the middle. The resulting shape of cross-member 40 thus allows the lower plate 76 to extend above the upper deck 56 of the platform 12 when the cross-member 40 is positioned with the lower plate 76 facing upwards rather than the upper plate.

Figure 15:
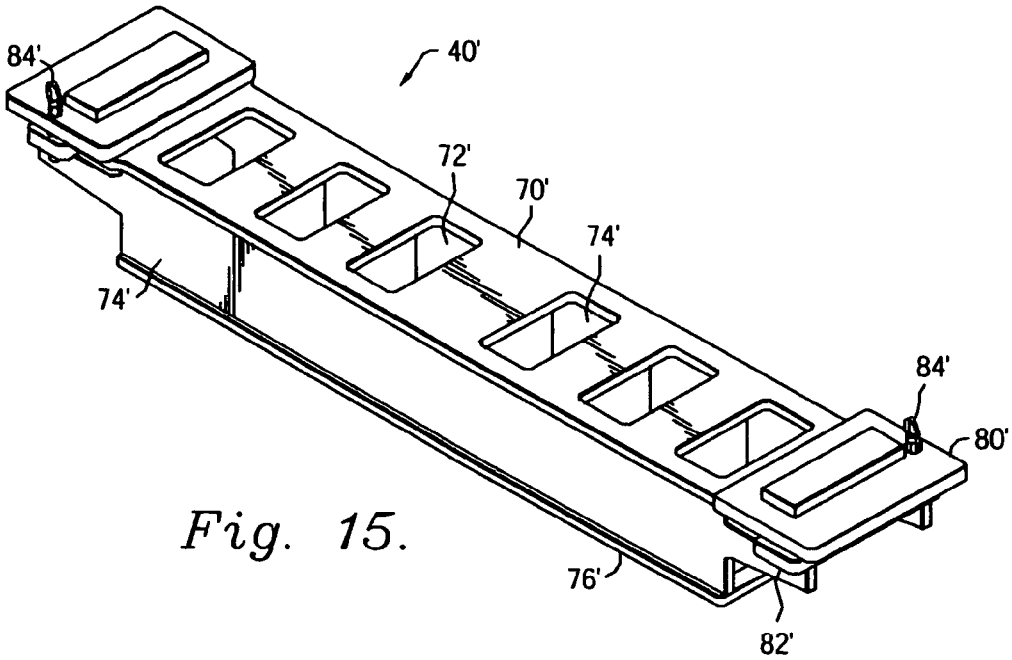
FIG. 15 is an enlarged perspective view of an alternative embodiment of the cross member of FIG. 2.
Figure 16:
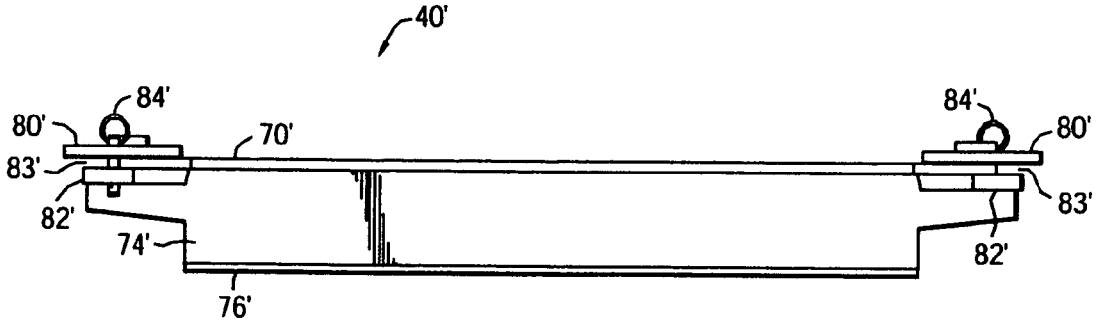
FIG. 16 is an enlarged side elevation view of the cross member of FIG. 15.

FIG. 15 illustrates an alternative embodiment of cross-member 40 and is designated 40'. The cross-member 40' includes an upper plate 70', a lower plate 76' and side plates 74'. The top and bottom plates 70', 76' each preferably have a plurality of anchoring apertures 72' therethrough. The top and bottom aperture 72' are in general alignment from top to bottom. The distal ends of the cross-member 40' are each provided with a mounting system for removably and movably mounting the cross-member 40' to the upper deck 56. It is preferred that the mounting system be of such a nature that the cross-member 40' may be mounted in an upright low profile position or in a position inverted, high profile, to the upright position. In one position, the top plate 70' will be at the top and in the inverted position the bottom plate 76' as seen in FIG. 15 will be in a top position. The mounting system and construction of the cross member 40' are such that in one position the cross-member is at a first level and in the inverted level will provide an elevated position to change the spacing between the cross-member 40' and a vehicle on the platform 12. As shown, the mounting system includes channel forming members 80', 82' defining a lateral extending channel 83' between the members 80', 82' and extending between the side edges 74'. A portion of the upper deck 56 will be received in each of the channels 83' with members 80', 82' providing vertical support for the cross-member 40'. To utilize the cross-member 40', a worker will move the cross-member 40' into the opening 41 and by cocking the cross-member 40' to a position where it is not perpendicular to the edges defining the opening 41, clearance is provided for rotational movement of the member 40' to a position where it is generally perpendicular to the edges defining the opening 41. The effective length of the cross-member 40' is increased by the rotation, snuggly fitting the cross-member 40' between the side edges of the opening 41. Once in the correct position, the cross-member 40' is secured against rotation out of position. One effective means of securing the cross-member 40' in the working orientation is through the use of pins 84' inserted through aligned apertures in the members 80', 82'. A suitable pin 84' is a hitch pin style pin. Through the use of the just described securement system, the member 40' may be easily installed in either its upright (low profile) or inverted (high profile) position.

Figure 3:
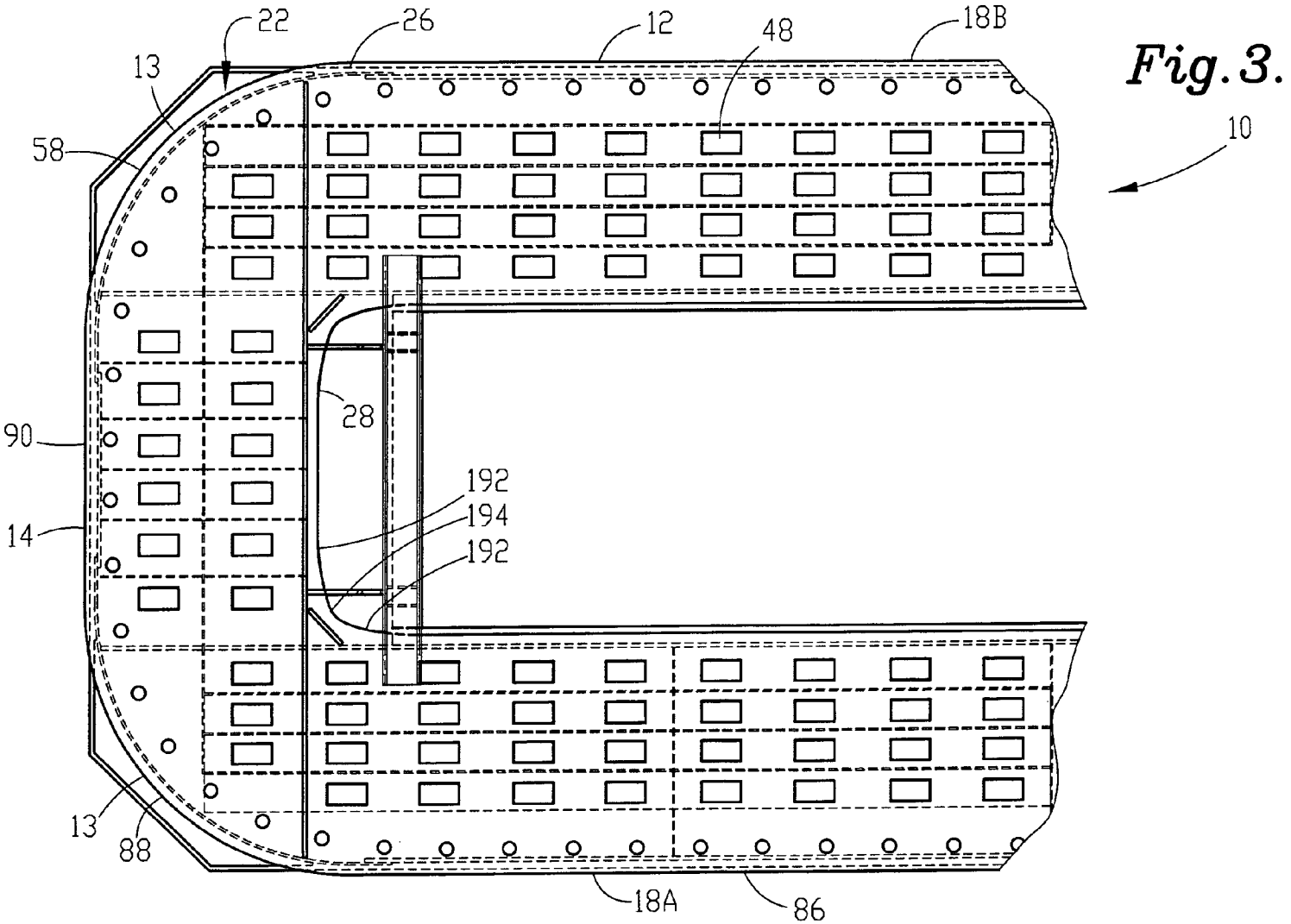
FIG. 3 is an enlarged fragmentary top view of the bench of FIG. 1 having sections broken away to reveal a lower deck, a carriage track, and a carriage assembly.

Referring to FIG. 3, the carriage track 22 extends along the length of the platform 12 and along both sides 18 of the platform. The carriage track 22 is preferably mounted to the bottom of the platform 12. The track 22 includes a pair of long linear section 86, curved corners 88 and a short linear sections 90 that extend across the rear end 14 and front end 16 of the platform 12. Thus, the carriage track 22 has a somewhat oval-shaped configuration. The arm assembly 20 is movably attached to the carriage track 22. The carriage track 22 includes an inner rail 28 and an outer rail 26. The inner track or rail 28 and outer track or rail 26 comprise the inner and outer edge portion of the lower deck 58. Specific details regarding the configuration of carriage track 22, and it various dimension will be discussed in further detail with reference to FIG. 10 later in this document. The outer rail 26 is at the outer lower perimeter of the platform 12 and the inner rail 28 is at the inner lower perimeter of the ends 14, 16 and sides 18 A, 18B.

Figure 4:
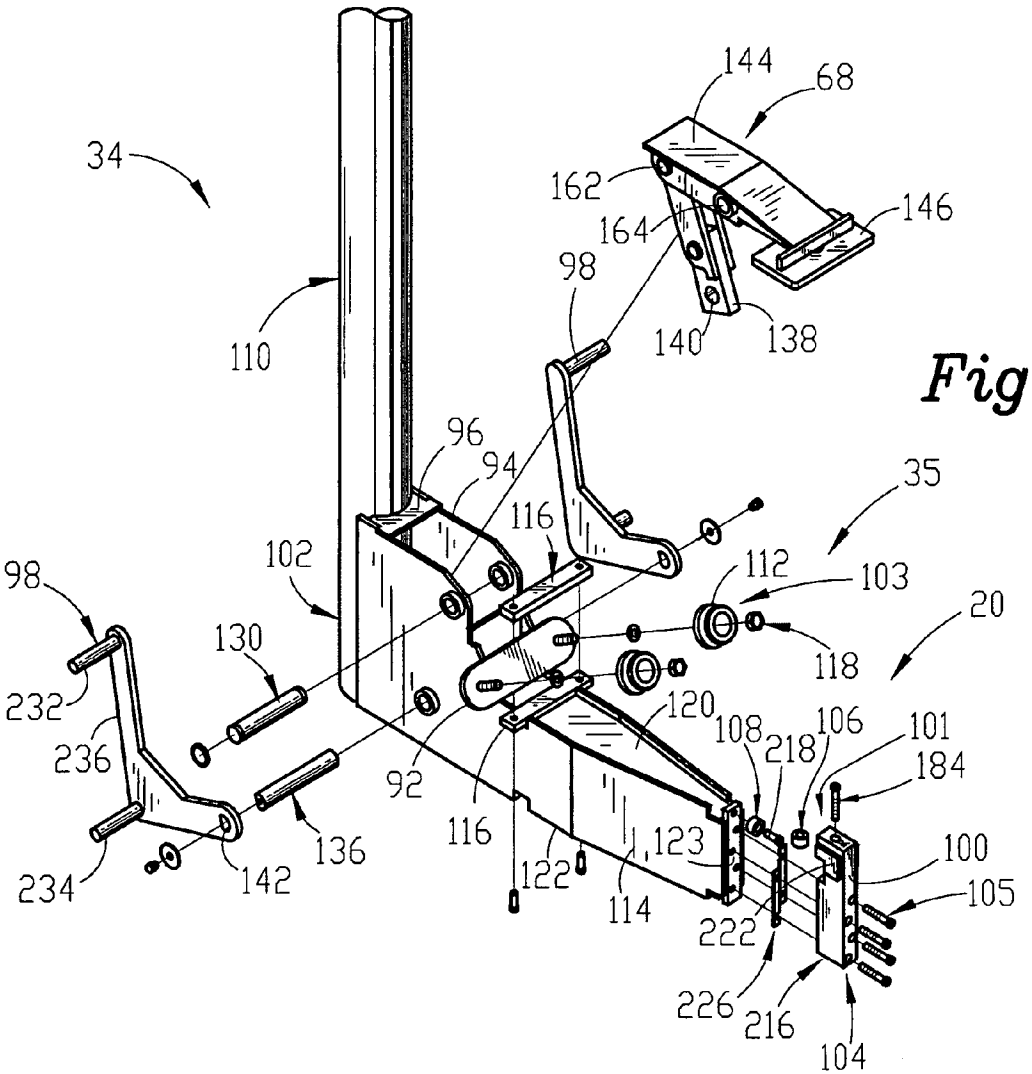
FIG. 4 is an enlarged exploded perspective view of one of the pulling assemblies of FIG. 1.
Figure 6:
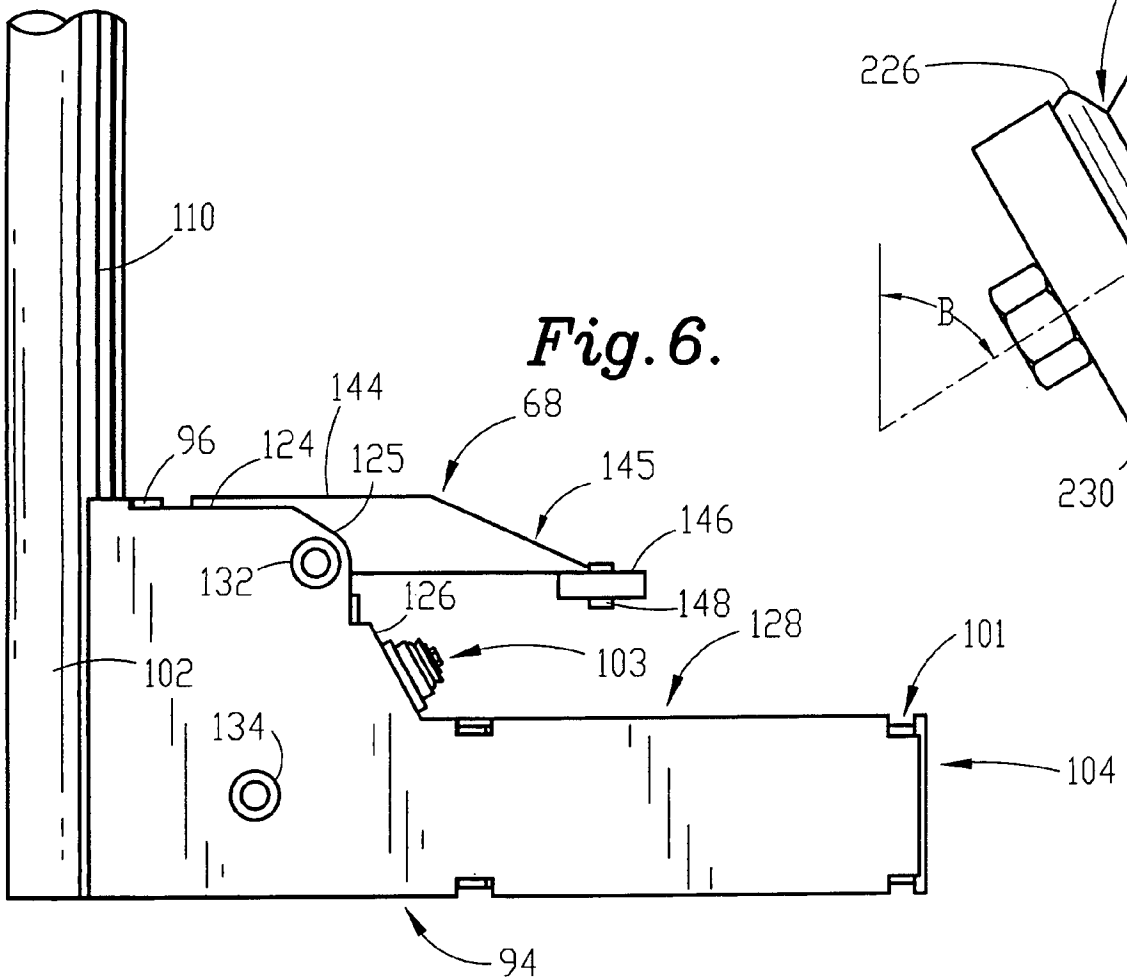
FIG. 6 is an enlarged side elevation view of the arm assembly of FIG. 4.

Referring to FIGS. 4 and 6, specifically in FIG. 4, the pulling assembly 34 is shown with an exploded view of the arm assembly 20 and the tower 110. As shown, the arm assembly 20 comprises a tower positioning mechanism 96, a pair of shim plates 116, an arm body 94, an inner guide assembly 104, a clamping mechanism 68, an elongated wheel bar 92, a top plate 120, a lower plate 122, and arm sides 114.

The pulling assemblies 34, including their component parts, are carried by carriage assemblies 35. A carriage assembly 35 includes wheel assemblies for both guiding the pulling assemblies 34 in their movement about the platform 12 and vertically supporting the pulling assemblies 34 on the platform 12. There is an inner positioned wheel assembly, designated generally 101, for cooperation with the inner rail 28 and an outer wheel assembly, designated generally 103, adapted to cooperate with the outer rail 26. The inner and outer wheel assemblies 101, 103 respectively, are described in more detail below.

The arm body 94 has a generally trapezoidal perimeter with an inwardly facing narrow end 100 and an outwardly facing wide end 102. The narrow end 100 mounts an inner guide assembly 104. The inner guide assembly 104 is positioned low on the body 94 and extends some distance from the tower 110. As the carriage assembly rolls along the track 22, the guide wheel or roller 108 rolls against the bottom of the platform 12 and the guide wheel or roller 106 rolls against the inner rail 28. More specifically, the guide wheel 108 rolls against the inner rail 28. The wide end 102 mounts a pair of channeled wheels 112 on the outer rail 26. The arm body 94 has a raised section 124, a beveled section 126 and a lower section 128 defined by the arm sides 114. The arm sides 114 have top and bottom aligned pivot holes 132, 134. The top plate 120 and lower plate 122 are recessed between the arm sides 114 on the lower section 128 of the arm assembly 20. The tower positioning mechanism 96 located on the top of the wide end 102 of the arm body 94 is curved on an end that receives the tower 110. The positioning mechanism 96 also covers a section of the raised arm section 124.

Figure 5:
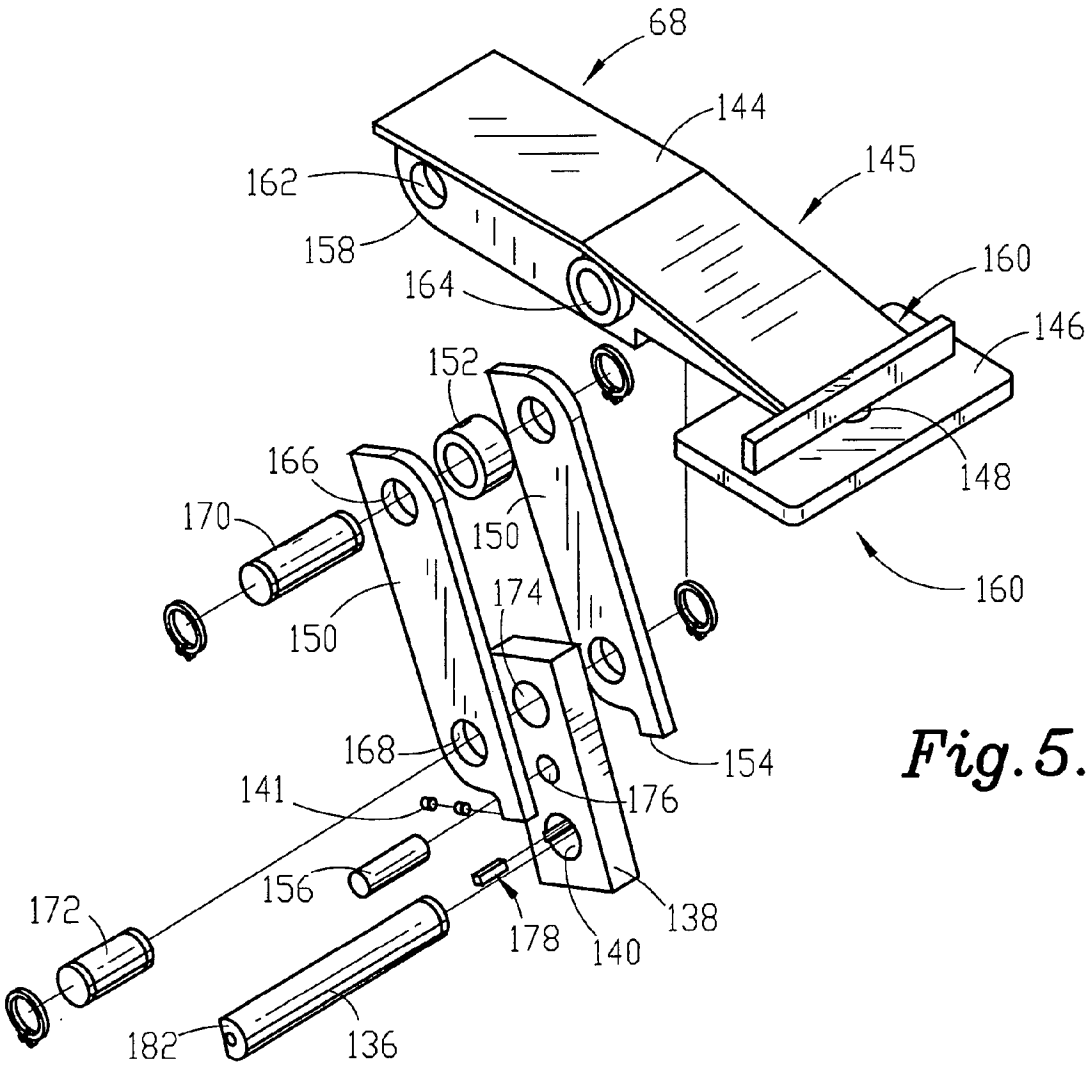
FIG. 5 is an enlarged exploded view of the locking mechanism of FIG. 4.

A clamping mechanism 68 is provided that is operable to clamp a pulling assembly 34 in position on the platform 12 and is operable to resist lateral movement of the pulling assembly along the track 22 and pivoting movement in a generally vertical plane of the arm body 94 during pulling operation of the pulling assembly 94. Clamping lifts the outside end of the pulling assembly 34 upwardly. A portion of the clamping mechanism 68 is located in a cavity between arm sides 114 and held in position by a pivot rod 130. Pivot rod 130 slides through the top aligned pivot holes 132 and fulcrum apertures 164 of the clamping mechanism 68. The clamping mechanism 68 rotatably moves about the axis of the fulcrum apertures 164 as it is engaged and disengaged. In the engaged state, the clamp front 160, FIG. 5, is lowered onto the platform 12 and the lock stop 148 is received into a lock aperture 30 to secure the pulling assembly 34 to the bench 10. In the disengaged state, the clamp front 160 is raised thereby removing the lock stop 148 from lock aperture 30. A driver dowel 136, which slides through driver apertures 140 and the bottom aligned pivot holes 134 of the arm body 20 is rigidly connected to a clamp lever 98. The clamp lever 98 has a lever aperture 142 shaped to receive the driver dowel 136. A portion of the driver dowel 136 extends beyond the surface of the arm side 114 to be received by the lever aperture 142 of the clamp lever 98. The clamp lever 98 is fastened to the driver dowel 136 on the outside of the arm body 20. The clamp lever 98 moves rotatably about the axis of the driver dowel 136. While a clamp lever 98 is shown on both sides of the pulling assembly 34, it is preferable to have a single clamp lever 98 operate the clamping mechanism 68. In addition the driver dowel 136 can be welded to the clam lever 98 thus dispensing with the need to have a particularly shaped driver dowel 136. As seen in FIG. 4, the clamp lever 98 on the near side is pivoted outwardly or counterclockwise to effect clamping and pivoting clockwise or inwardly will effect unclamping.

With continued reference to FIG. 4 channeled wheels 112 are mounted onto opposite ends of the elongated wheel bar 92, which rests on the beveled section 126 of the arm assembly 20, by wheel fastener 118. The beveled section 126 has an axial angle that enables the channeled wheels 112 to rest squarely on the outer rail 26 of the carriage track 22. The details relating to the structure of the channeled wheel 112, the carriage track 22 and the axial handle will be discussed later in this document with reference to FIGS. 7, 8, 9 and 10. The shim plates 116 adjust the thickness of the clamping mechanism to secure the pulling assembly 34 to the platform 12.

Referring to FIG. 5, an exploded view of the linkage for the clamping mechanism 68 is shown. As shown, the clamping mechanism 68 comprises a clamp arm 145 with a rectangular beveled top plate 144, a pair of support frames 158 tapered at the clamping end, a contact plate 146 having a protruding lock stop 148 in the form of a downwardly directed pin. The clamping mechanism also includes a pair of clamp brackets 150 having tabs 154 on one end, and a driver 138. The driver 138 provides a hinge aperture 174, a tab stop aperture 176 and a driver aperture 140. The support frames 158 are bifurcated to define a central opening and are oriented to have its tapered ends along the slope of the top plate 144, to define a clamp front 160. The top plate 144 is fixedly attached to the contact plate 146 at the clamp front 160. The support frame 158 has a pair or aligned fulcrum apertures 164 and support apertures 162. The clamp brackets 150 each have a top aperture 166 and lower aperture 168. A spacer bushing 152 is located between the clamp brackets 150 and is aligned with the top aperture 166 of each clamp bracket 150. The bushing 152 is sized to the same width as the driver 138 and provides an equal separation at the top end of the clamp brackets 150 as the driver 138 provides at the bottom end of the clamp brackets 150. A fulcrum rod 170 pivotly connects the clamp brackets 150 and bushing 152 to the support frame 158 through the top apertures 166 the support apertures 162. A hinge rod 172 pivotly connects the clamp brackets 150 and driver 138, through the lower apertures 168 and hinge aperture 174 of driver 138. The driver 138 is able to pivot about the axis of the hinge rod 172. However, the pivoting of the driver 138 relative to the clamp brackets 150 is limited by the tab extension 154 of the clamp bracket 150 and the tab stop pin 156. In operation, engagement between the tab stop pin 156 and tab extensions 154 arrest or limits the motion of the driver 138 to a position that is approximately three degrees past linear alignment of the pivot axes of the driver 138 and the clamp brackets 150 with the pivot axis of the driver dowel 136 forming an over center lock arrangement. The driver dowel 136 is shaped and positioned such that it cannot rotate relative to the driver 138 within the driver aperture 140. A dowel wedge 178 is located with the driver aperture 140 and is secured in place by a pair of wedge plugs 141 in the form of set screws or bolts. A longitudinal section of the driver dowel 136 is removed to expose a substantially planar surface 182 that is mated to a flat in the dowel receiving aperture 142 in lever 98 to prevent relative rotation. When the driver dowel 136 is rotated, the relative rotation between the driver dowel 136 and the driver 138 through the use of dowel wedge 172 keying the driver dowel 136 and driver 138 together.

As previously discussed, a clamp lever 98 having an upper handle 232, a lower handle 234 and a lever body 236, is securely connected to the driver dowel 136. A movement of the clamp lever 98 about the axis of the lever aperture 142 forces the driver dowel 136 to rotate in unison. The rotation of the driver dowel 136 moves the driver 138 rotatably about the axis of the hinge aperture 174 in the same direction as the movement of the clamp lever 98.

In operation, when an operator wants to raise the locking mechanism 68 and thus free the pulling assembly 34 to move about the carriage track 22, the operator does so by moving the clamp lever 98. For example, the operator pushes the upper handle 232 of a clamp lever 98 in an upward and forward direction towards the narrow end 100 of the arm assembly 20. The motion of the clamp lever 98 in this direction forces a rotation of the clamping mechanism 68 about the fulcrum aperture 164. The rotation of the clamping mechanism is opposite in direction to that of the clamp lever 98. As such, in the current example, the clamping mechanism rotates in a direction that lowers the linkage inside the arm and raises the clamp front 160 thus disengaging the lock stop 148 from an aperture 30. The clamping mechanism can be lowered or engaged by moving the clamp lever 98 in the opposite direction, away from the bench 10 and narrow end 100 of the arm assembly 20. This motion causes the driver dowel 136 to rotate in the direction of the lever 98, engaging the dowel wedge 178 and causing the driver 138 to also rotate in the same direction about the hinge rod 172 axis. As the driver 138 rotates, the driver tab pin 156 encounters the tab extensions 154 of the clamp brackets 150, locking the driver 138 in near linear alignment with the clamp brackets 150. The clamp brackets and driver move a little (approximately three degrees) past linear alignment creating an over-center lock. Unlocking the clamp with forward motion requires overcoming the force of the over-center lock, which is in part controlled by how many shims are used in the clamp assembly. The lower handle 234 provides an alternate means to cause the rotation of the clamp lever 98, with the same result.

Mounted to the narrow end 100 of the arm assembly 20 is an inner guide assembly 104. The inner guide assembly 104 includes a horizontal guide roller 106, rotatably attached with a guide pin 184 to the guide body 216. The guide body 216 is securably attached to a front plate 123 of the arm assembly 20. The inner wheel assembly 101 includes wheels or rollers 106, 108. A guide roller 106 is recessed and rotatably connected to the guide body 216 by a guide pin 184. A support wheel 108 centered on a horizontal axis is secured to the front plate 123, adjacent to the guide roller 106, with a guide wheel anchor 218. The support wheel 108 and guide roller 106 are positioned within a notched section 222 of the guide body 104 so as to allow a flush attachment of the face plate 123 to the guide body 216. A pair of guide spacers 226 (most machines use four spacers) provide the clearance necessary for the support wheel 108 to be exposed for contact by the lower or bottom surface of the inner rail 28 and can be used to fix the spacing between roller 106 and wheels 112. When the arm assembly 20 is on the track 22, the guide roller 106 is in contact with the inside edge of the inner rail 28 and the guide roller 108 contacts the bottom surface of the inner rail 28. A portion of the inner rail 28 protrudes into the notched section 222 with the inner edge 28E, contacting the guide wheel 106 to guide movement of the pulling assembly 34 and its component parts around the platform 12. A section of the inner rail 28 thus overlaps the guide roller 108 and provides a surface on which the roller 108 moves as the pulling assembly 34 is moved.

The outer wheel assembly includes a pair of channeled wheels 112A, 112B (FIGS. 10, 11) collectively referred to as wheels 112 provide a mechanism for mounting the pulling assembly 34 along the carriage track 22. The channeled wheels 112 rest at an axial angle to the carriage track 22, such that a wheel channel 214 sits squarely on the carriage track 22. In other words, the channeled wheel 112 is positioned with the front bevel surface 228 parallel to the top of the carriage track 22, while the rear bevel surface 230 sits parallel to the outer edge of the carriage track 22. As the pulling assembly 34 is moved around the bench 10, the channeled wheels 112 remain in continuous contact with the carriage track 22. The surface 228 rests on the top 26T of the outer guide track or rail 26 to support the pulling assembly 34 and its components parts vertically. The surface 230 is adapted to engage the outer edge 26E of the track 26 to guide movement of the pulling assembly 34 about the platform 12.

Figure 7:
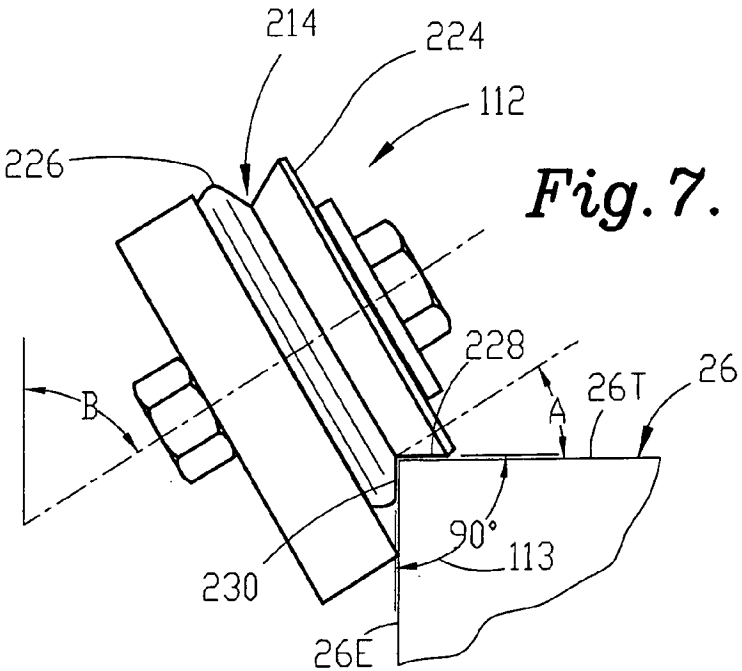
FIG. 7 is an enlarged side view of the channeled wheels for moving the pulling assembly along the carriage track.
Figures 8, 9:
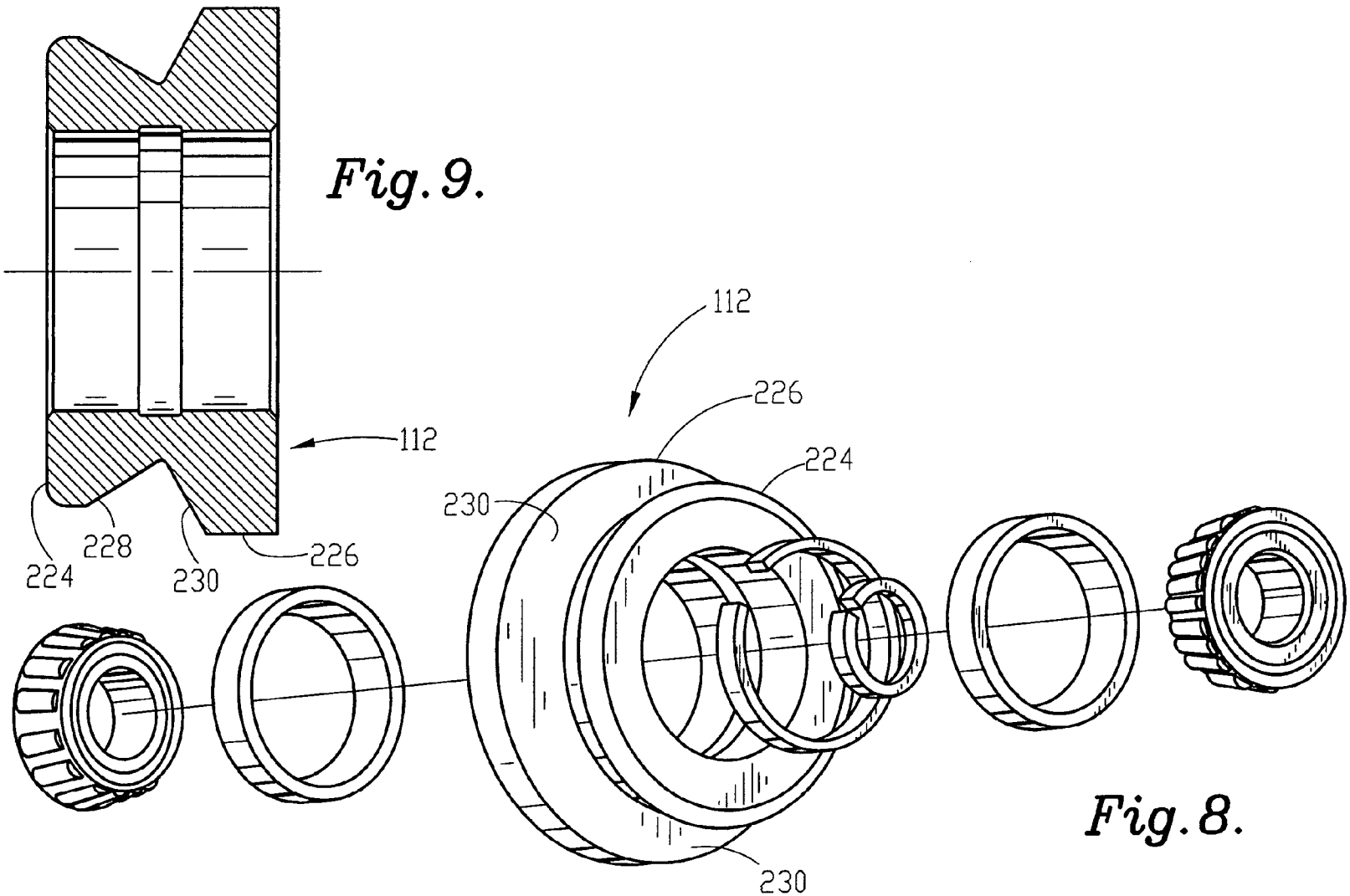
FIG. 8 is an enlarged exploded perspective view of the roller and bearing assembly of FIG. 7.
FIG. 9 is an enlarged cross-sectional view of the roller of FIG. 7.

Referring to FIGS. 7, 8, and 9, the channeled wheels 112 have front portion 224 and a rear portion 226 with a channel 214 between them. The channel 214 having a front bevel surface 228 and a rear bevel surface 230. The channel 214 receives therein the carriage track 22 and keeps the pulling assembly 34 connected to the track in conjunction with the inner guide assembly 104 as the assembly 34 is moved around. The front portion 224 has a smaller diameter than the rear portion 226. The channel 214 lies between the front portion 224 and rear portion 226, with a channel angle 113 of approximately ninety degrees. The channel angle 113 is formed between the front bevel surface 228 of the front portion 224 and the rear bevel surface 230 of the rear portion 226. The front bevel surface 228 lies at an angle A of approximately thirty degrees from the longitudinal axis of the channeled wheel 112 and the wheel axis is tilted at an angle B of approximately sixty degrees from vertical. Thus, the wheel axis is at an angle of approximately thirty degrees with respect to the lower and upper decks (58, 56). The rear bevel surface 230 of the rear portion 226 lies at an angle of ninety degrees from the front bevel surface 228. In a preferred embodiment of the present invention, the outer edge of the front portion 224, which is located opposite to the channel 214, is rounded. At the point of contact between the channeled wheel 112 and the carriage track 22, the rear bevel surface 230 is substantially vertical and the front bevel surface 228 is substantially horizontal.

Figure 10:
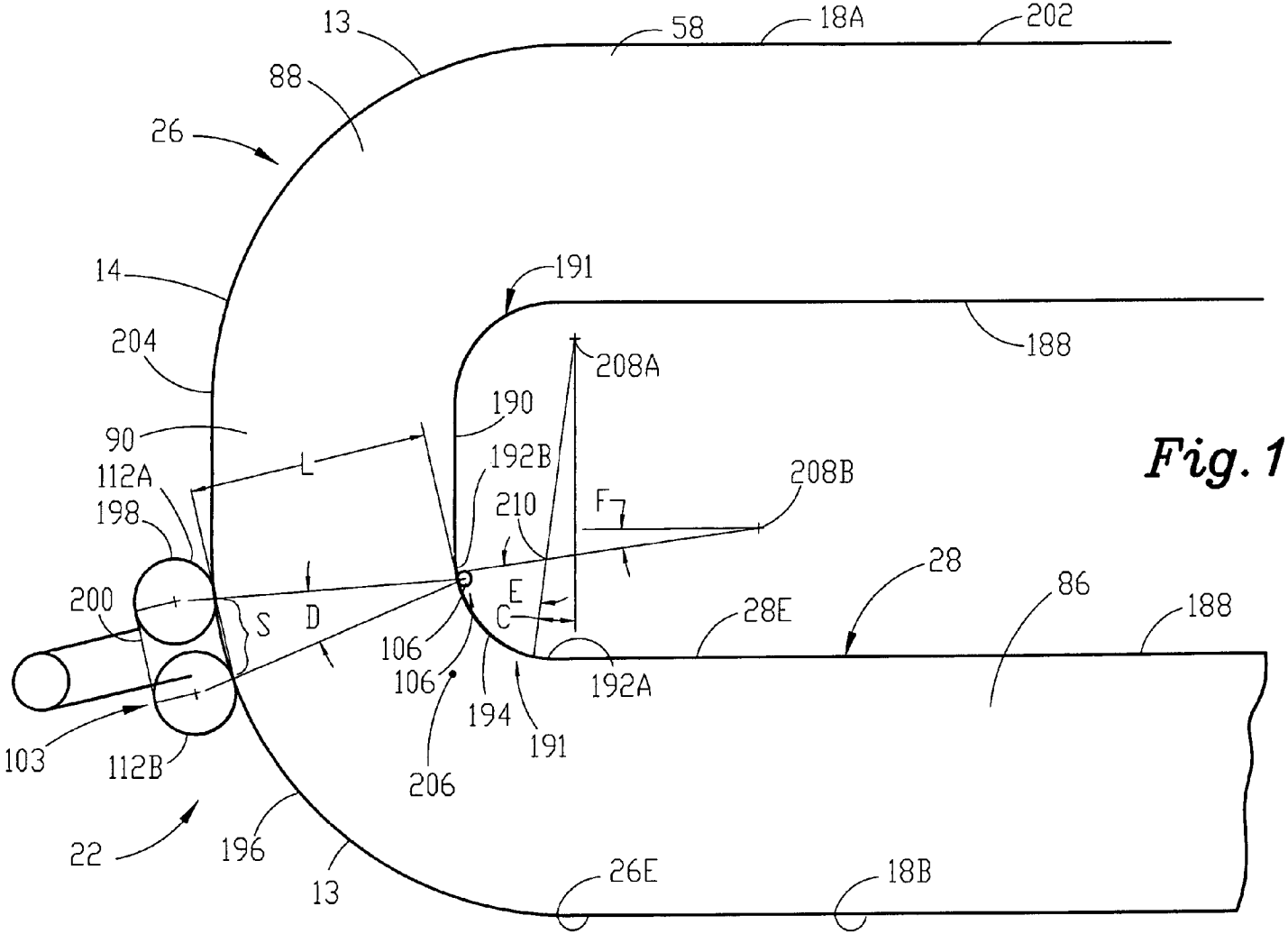
FIG. 10 is an enlarged schematic diagram of a portion of the carriage track showing two corners.

Referring to FIGS. 3 and 10 the carriage track 22 is defined by the outer rail 26 and inner rail 28. The rails 26, 28 are defined by linear and arcuate sections. In particular, the inner rail 28 is defined by a pair of long linear inner sections 188, a pair of short linear inner sections 190, a plurality of inner curved sections 191 comprising transitional arcs 192 and a plurality of inner arcs 194. The outer rail 26 is defined by a pair of long linear outer sections 202, a pair of short outer sections 204 and an outer arcs 196. There is a correlation between the various arcs 192, 194, 196, the wheel separation 200 and the channel radius 198 of the channeled wheels 214.

Figure 14:
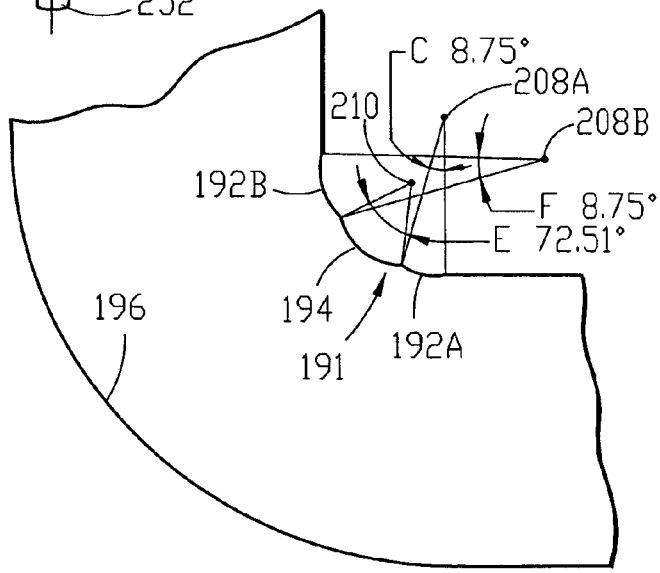
FIG. 14 is a diagrammatic sketch of the track contours at a carriage track corner with certain dimensions exaggerated to better illustrate the corner edge contours.

To effect movement of a pulling assembly 34 about a corner 13, a particular construction is provided for smooth non-binding movement about the corners. The rails 26, 28 are provided with curved or arcuate portions at the corners 13 extending from the ends of the sides 18A, 18B and the ends 14, 16 in their generally linear sections. This is best seen in FIG. 10. The inner and outer wheel arrangements 101 or 103 are positioned relative to one another and are retained in fixed relationship to one another in a manner to provide a smooth transition from a side to an end or an end to a side by the pulling assemblies 34. In a preferred embodiment, the outer wheel assembly 103 includes a pair of rotatable wheels 112. An inner wheel assembly 101 includes at least one rotatably mounted guide wheel 106 and at least one rotatably mounted support wheel 108. In a preferred embodiment of the present invention, only two wheels 112 are used and only one guide wheel 106 is used. However, other embodiments may be provided as will be better understood by description of the wheel arrangements provided below. The angle D between two rays passing through the center of the wheels 112 and being generally normal to a tangent at the point of contact of the wheels 112 with the rail 26 will, when one wheel 106 is used, pass through the center of that wheel 106. The angle D is preferably within the range of about 5° and about 35° preferably in the range of between about 15° and about 30° and more preferably in the range of between about 20° and about 25°. Another way to express the positional relationship between the wheels 106, 112 is by the relationship between the distances S and L where S is the distance between the points of contact of the wheels 112 with the edge of the outer rail 26 at the corner 13 and where L is the distance between those points of contact and the point of contact of the wheel 106 with the edge of the inner rail 28. The ratio, S/L is in the range of between about 0.1 and about 0.6, preferably in the range of between about 0.3 and about 0.5 and more preferably in the range of between about 0.35 and about 0.45. As just described, an inner curved section 191 is comprised of a pair of transitional arc portions 192, one at each end of an inner arc portion 194. It is preferred that the transitional arcs 192 be spaced along rays projecting inwardly and being generally normal to a tangent to a particular point on the outer rail 26 be spaced greater than the transitional arc portions 192 than the spacing between the inner arc portion 194 and its corresponding portion of the curve of the outer rail 26. Thus, the transitional arc portions force the inner guide wheel inwardly keeping both of the outer wheels substantially on the outer track. This is best seen in FIG. 14 where the dimensions are exaggerated for clarity. Particular embodiments of the rail contours which are preferred embodiments, are described below. The wheel arrangements of the wheels in the inner and outer wheel assemblies 101, 103 are arranged in a generally triangular arrangement as best seen in FIG. 10, i.e., the spacing between the wheels 112 is significantly larger than the spacing between multiple wheels 106 if multiple wheels 106 are used. If a single wheel 106 is used, then an apex of the triangular arrangement would be through the center of the wheel 106 and the two sides of the triangle defining the angle D would pass through the center of the wheels 112.

In a preferred embodiment, the correlation is designed to ensure smooth and continuous contact of both channeled wheels 112 to the outer rail 26, as the pulling assembly 34 is moved around the platform 12 on the carriage track 22. Each arc 192, 194, 196 is defined by a combination of an angle of arc and a radius from various specific reference points lying on the plane of the carriage track 22. The transitional arc 192 represents a section of the inner rail 28 located between the inner arc 194 and each of the linear inner sections 188, 190 of inner rail 28. In other words, when the pulling assembly 34 is being moved around the carriage track 22, it has one channeled wheel 112A on the long outer section 202 and the other channeled wheel 112B on the outer arc 196, the wheel 106 is in a transitional arc 192.

During the transition, the guide roller 106 lies on a portion of the inner rail 28, which is shown and designated as a transitional arc 192A. The first transitional arc 192A is located between the long linear inner section 188 and the inner arc 194. Similarly, when one channeled wheel 112A is on the short outer section 204 and the other channeled wheel 112B is on the outer arc 196, the wheels are said to also be in transition, and the guide roller 106 lies on a second transitional arc 192B. The second transitional arc 192B is located between the inner arc 194 and the short linear inner section 190. These transitional arcs 192A, 192B are collectively referenced as transitional arc 192 to facilitate the description of the invention.

A reference point 206 is the focal starting point for the various radial distances employed in providing the arcs 192, 194 of the inner rail 28. The reference point 206 is the intersection of a line extended along the long linear inner section 188 with a line extended along the short linear section 190. As would be understood, given the shape of the carriage track 22 there will be four reference points 206. The closest of these to a particular corner of the carriage track is utilized as the reference point 206 for the arcs of that corner.

As illustrated in FIG. 10, the first transition arc 192A has a radius of approximately 30 inches and an angle of arc C of approximately 8.75°. The radial center of the first transition arc 192A namely transition center 208A, is located at a position with approximate relative x,y coordinate of 12 inches (preferably 12.0192 inches by calculation), 30 inches from the reference point 206. Similarly, the center for the second transitional arc 192B namely transition center 208B, is located at a position with approximate relative x,y coordinates of 30 inches (preferably 30.0000 by calculation), 12 inches (preferably 12.0192 inches by calculation) from the reference point 206, with an approximate radius of 30 inches and extends over an angle of arc F of approximately 8.75°. An inner arc center 210 is located at approximate x,y coordinates 8.75 inches, 8.75 inches from the reference center 206 and has an approximately radius of 8.75 inches and extends over an angle of arc E of approximately 72.51 degrees. As previously discussed, there is a correlation between the various radii and angles of the inner rail 28 arcs 192A, 192B, 194, the outer arc 196 and the dimensions and positions of the channeled wheels. The channel radius 198 of each channeled wheel 112 is about 3.876 inches, the distance between the centers of the channeled wheels 112 is approximately 8.75 inches and the radius of the outer arc 196 is approximately 32.5 inches for a preferred embodiment.

It should be noted that all dimensions specified herein are illustrative only and would vary for larger or smaller benches or wheels. The numbers provided are an example of the relationship between the various dimensions that they represent.

In the preferred embodiment of the present invention, the previously recited radii and angles achieve constant contact through the transition of the outer wheels from straight rail to curved rail.

Figure 11:
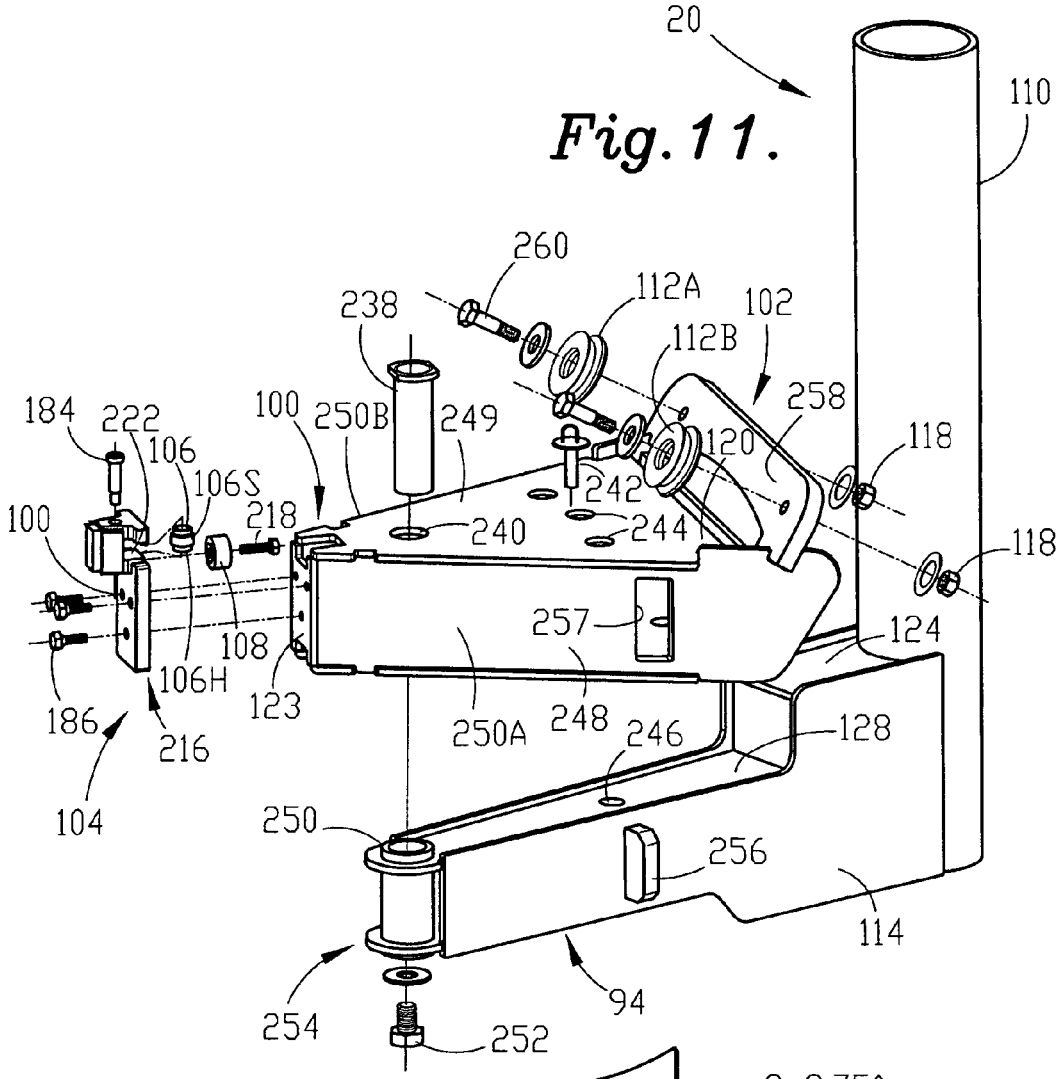
FIG. 11 is an enlarged perspective view of an alternate embodiment of the pulling assembly of FIGS. 1 and 4.

An alternate embodiment of the pulling assemblies of FIG. 1 having a corresponding arm assembly 20, exploded away from the pulling assembly tower 110 is illustrated in FIG. 11. As shown, the arm assembly 20 comprises a carriage body 248, an arm body 94, an inner guide assembly 104, a guide body 216 and channeled wheels 112.

The arm body 94 has a generally trapezoidal perimeter with a lower section 128, a raised section 124 and a narrow rounded end 254 located on the distal end of the lower section 128. The rounded end 254 has an arm swing aperture 250 adapted to receive a swing rod 238 for moveably mating the carriage body 248 to the arm body 94. Also located on the lower section 128 is an assembly lock aperture 244 adapted to receive an assembly lock pin 242. The assembly lock pin 242 enables the arm body 94 to be locked in a fixed position relative to the carriage body 248, and prevents the rotatable movement between the carriage body 248 and the arm body 94. In other words, the pulling tower 110 can be locked in position relative to the carriage body 248 as best illustrated and in the top perspective view of FIG. 12. When the arm body 94 and consequentially the tower 110 are centered relative the carriage body 248, the carriage aperture 244 and assembly lock aperture are aligned and the tower 110 can be secured in place by the assembly lock pin 242. It should be understood that a plurality of apertures and lock pins could be located on the carriage body 248, thus allowing variations in the relative position of the tower 110. The arm body 94 has a pair of opposed arm sides 114 that are substantially perpendicular to the lower section 128 and raised section 124. Protruding from each arm side 114 is a side cusp 256.

The carriage body 248 also has a generally trapezoidal perimeter with an inwardly facing narrow end 100 and an outwardly facing wide end 102. In the preferred embodiment, the carriage body 248 has a top plate 249 and side plates 250 A, B that are substantially perpendicular to the top plate, thus defining an open ended substantially trapezoidal cavity there between. The cavity of the carriage body 248 receives a section of the arm body 94 defined by the lower section 128. The narrow end 100 mounts an inner guide assembly 104. The inner guide assembly 104 comprises a guide wheel or roller 108, which rolls against the bottom of the platform 12 and a guide wheel or roller 106, which rolls against the inner rail 28. The guide wheel 108 is secured about a horizontal axis by a guide wheel anchor 218 to the guide body 216. The guide roller 106 is secured within a notched section 222 of the guide body 216 about a vertical axis by guide pin 184. The guide wheel 108 and guide roller 106 are positioned to rotate in close proximity of each other at a substantially perpendicular angle. The guide body 216 is attached to the front plate 123 of the narrow end 100 of the carriage body 248. Located on the wide end 102 of the carriage body 248 is a raised plate 258, which rests at an obtuse angle to the surface of the carriage body 248. The channeled wheel 112 is fastened to the plate 258 by an axle bolt 260 and fastener 118. The obtuse angle of the raised plate 258 is such that it allows the front bevel 228 and rear bevel 230 of the fastened channeled wheel 112 to rest substantially squarely on the carriage track 22. The channeled wheel 112 has an angle of approximately 90 degrees between the two beveled surfaces 228, 230.

Figure 12:
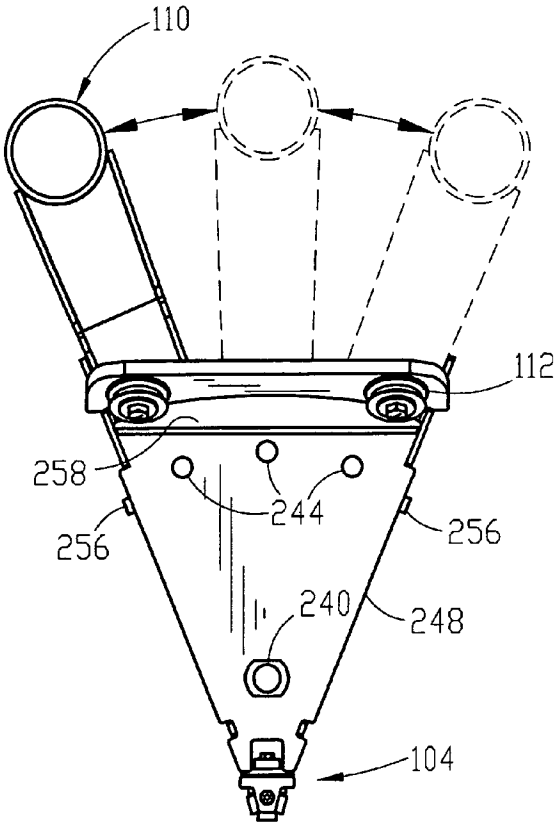
FIG. 12 is an enlarged top view of the arm assembly of FIG. 11.

Turning to FIG. 12, the carriage body 248 is shown with three potential positions for the tower 110 and arm body 94. As shown, when the tower 110 is positioned at either of two positions where the arm body 94 is flush with the side of the carriage body 248, the alignment projections 256 extend outwardly and each may protrude through a respective receiver 257 in the form of a through hole in the sides of the carriage body 248. By having a close fit between a projection 256 and its receiver 257 the respective side plate may be made load bearing. The assembly lock pin 242 is then utilized to secure the tower 110 and arm body 94 in position by aligning the respective apertures 244 with the aperture 246. Pulling force may be used to hold tower 110 and arm body 94 in either of the two side positions whereby the two outside apertures 244 need not be utilized.

Figure 13:
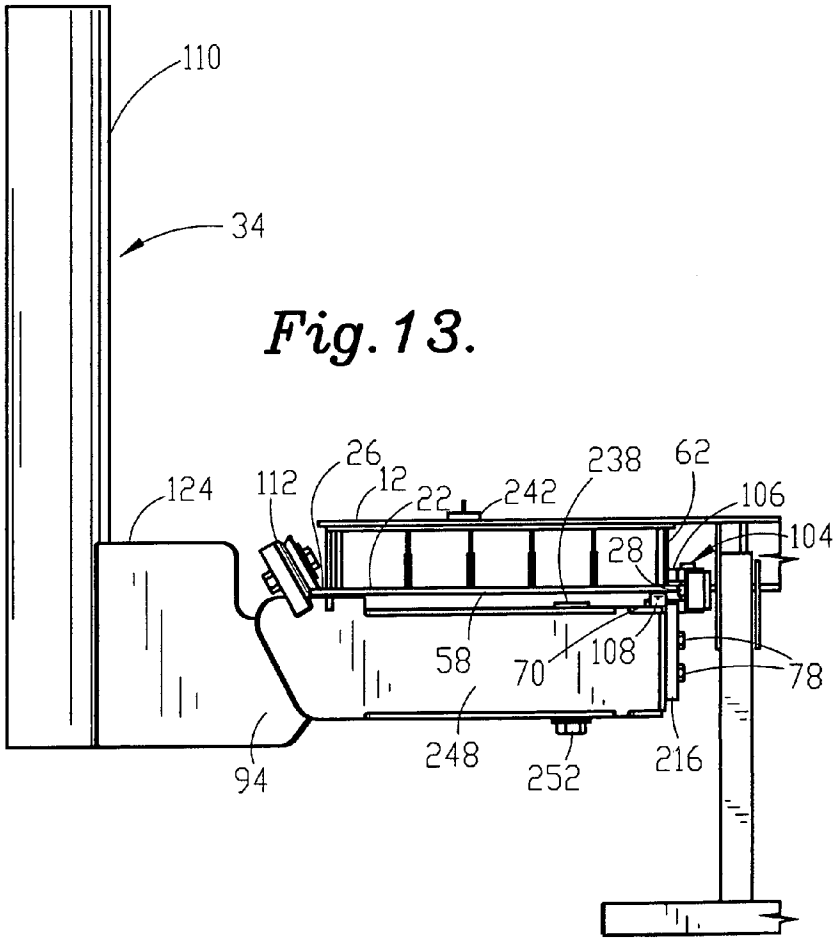
FIG. 13 is an enlarged side elevation view of the pulling assembly of FIG. 11 shown connected to the straightening bench of FIG. 1A.

In operation, the arm assembly 20 is attached to the carriage track 22 as illustrated in FIG. 13. As shown, the arm assembly 20 including the tower 110 and arm body 94 are coupled to the carriage body 248 by the swing rod bolt 252. The entire arm assembly 20 and carriage body 248 combination is mounted to the carriage track 22. The combination engages the track on the outer rail 26 via the channeled wheels 112 and on the inner rail 28 via the inner guides assembly 104. Specifically, the guide wheel 108 contacts the underside of the inner rail 28 and the guide roller 106 contacts the outer edge of the inner rail 28. A portion of the inner rail 28 protrudes into the notched section 222.

Thus, a vehicle-straightening bench 10 is disclosed which utilizes movable carriage assemblies with mounted pulling towers. The pulling towers can be located at almost any position around a vehicle chassis to restore the chassis to an original configuration. While preferred embodiments and particular applications of this invention have been shown and described, it is apparent to those skilled in the art that many other modifications and applications of this invention are possible without departing from the inventive concepts herein. It is, therefore, to be understood that, within the scope of the appended claims, this invention may be practiced otherwise than as specifically described, and the invention is not to be restricted except in the spirit of the appended claims. Though some of the feautres of the inventin may be claimed in dependency, each feature has merit if used independently.

What is claimed is:

1. A vehicle straightening bench for applying force to a vehicle chassis to restore the chassis to a desired configuration, the bench comprising:

a vehicle platform having generally opposed ends and generally opposed sides;

a carriage track associated with the vehicle platform, the carriage track including an inner guide track and an outer guide track, the inner and outer guide tracks having generally straight sections extending substantially the length of and parallel to the platform ends and sides and curved sections joining the straight sections, at least one of the inner and outer guide tracks having a multi-radius portion in at least one of its curved sections; and a pulling assembly movably received by the carriage track.

2. The bench according to claim 1 wherein the multi-radius portion includes a transition radius portion and an intermediate radius portion, the transition radius portion having a radius larger than the radius of the intermediate radius portion.

3. The bench as set forth in claim 2 wherein there is a transition radius portion at each end of the intermediate radius portion.

4. The bench as set forth in claim 1 wherein the multi-radius portion is part of the inner guide track.

5. A vehicle straightening bench for applying force to a vehicle chassis to restore the chassis to a desired configuration, the bench comprising:

a vehicle platform having generally opposed sides and generally opposed ends, the platform including a carriage track system, the carriage track system comprising an outer carriage track and an inner carriage track, the inner carriage track positioned inwardly of the outer carriage track; and at least one pulling assembly with each pulling assembly including a carriage that is movably received by the carriage track system, the carriage including an inner guide wheel engageable with the inner carriage track and at least two outer guide wheels engageable with the outer carriage track, the outer guide wheels being tilted.

6. The bench according to claim 5 wherein at least two of the outer guide wheels are spaced apart a distance to provide an angle of arc of separation in the range of between about 15° and about 30°.

7. The bench according to claim 5 wherein the pulling assembly includes a clamping mechanism for engaging the vehicle platform and releasably locking the pulling assembly at a location relative to the platform.

8. The bench according to claim 7 wherein the clamping mechanism includes a latch mechanism operable to move a clamp member into and out of clamping engagement with the platform, the latch mechanism including an over center lock arrangement to secure the latch mechanism in latching engagement with the platform.

9. The bench according to claim 8 wherein the platform comprises an upper deck defining a plurality of lock apertures operable to receive a lock stop from the over center lock arrangement to secure the latch mechanism in latching engagement with the platform.

10. The bench according to claim 5 wherein the outer carriage track and said inner carriage track extend along the sides and the opposed ends forming a generally continuous outer carriage track and inner carriage track around the platform.

11. The bench according to claim 5 wherein the inner carriage track includes a plurality of generally linear sections and a plurality of generally arcuate sections.

12. The bench according to claim 11 wherein at least one arcuate section includes a transition section and an intermediate section with the transition section having a spacing from the outer track greater than the spacing between the outer carriage track and the inner carriage track at the intermediate section.

13. The bench according to claim 5 wherein the outer guide wheels have peripheral channels for receiving therein a portion of the outer carriage track.

14. A vehicle straightening bench for applying force to a vehicle chassis to restore the chassis to a desired configuration, the bench comprising:

a vehicle platform having generally opposed sides and generally opposed ends, the platform including a carriage track system, the carriage track system comprising an outer carriage track and an inner carriage track, the inner carriage track positioned inwardly of the outer carriage track; and at least one pulling assembly with each pulling assembly including a carriage that is movably received by the carriage track system, the carriage including an inner guide wheel engageable with the inner carriage track and at least two outer guide wheels engageable with the outer carriage track, the outer guide wheels having peripheral channels for receiving therein a portion of the outer carriage track.

15. The bench according to claim 14 wherein the outer wheels having channels each includes a circumferential channel with a first channel surface engaging the horizontal surface of the outer carriage track and a second channel surface engaging a vertical edge of the outer carriage track.

16. The bench according to claim 14 wherein at least two of the outer guide wheels are spaced apart a distance to provide an angle of arc of separation in the range of between about 15° and about 30°.

17. The bench according to claim 16 wherein the pulling assembly includes a clamping mechanism for engaging the vehicle platform and releasably locking the pulling assembly at a location relative to the platform.

18. The bench according to claim 17 wherein the clamping mechanism includes a latch mechanism operable to move a clamp member into and out of clamping engagement with the platform, the latch mechanism including an over center lock arrangement to secure the latch mechanism in latching engagement with the platform.

19. The bench according to claim 18 wherein the platform comprises an upper deck defining a plurality of lock apertures operable to receive a lock stop from the over center lock arrangement to secure the latch mechanism in latching engagement with the platform.

20. The bench according to claim 14 wherein the outer carriage track and said inner carriage track extend along the sides and the opposed ends forming a generally continuous outer carriage track and inner carriage track around the platform.

21. The bench according to claim 20 wherein the inner carriage track includes a plurality of generally linear sections and a plurality of generally arcuate sections.

22. The bench according to claim 21 wherein at least one arcuate section includes a transition section and an intermediate section with the transition section having a spacing from the outer track greater than the spacing between the outer carriage track and the inner carriage track at the intermediate section.

23. The bench according to claim 14 wherein the outer guide wheels are tilted.

24. A vehicle straightening bench for applying force to a vehicle chassis to restore the chassis to a desired configuration, the bench comprising:

a vehicle platform including generally opposed ends and generally opposed sides; and a pulling assembly including a carriage, the carriage moveably mounting the pulling assembly to the platform, and a clamp mechanism, the clamp mechanism comprising a pivotally mounted clamp member having an end moveable into and out of a clamping engagement with the platform, a latch mechanism operably connected to the clamp member and operable to move the clamp member into and out of clamping engagement with the platform, the latch mechanism including members operable to form an over center lock arrangement to secure the latch member in latching engagement with the platform, and a lock device operable, when the clamp member is in clamping engagement with a portion of the platform, to substantially prevent lateral movement of the pulling assembly about the platform.

25. The bench according to claim 24 wherein the lock device includes a pin selectively receivable within an aperture in a portion of the platform when the clamp member is in clamping engagement with a portion of the platform.

26. The bench according to claim 25 including a lever mounted to the latch mechanism to selectively effect clamping engagement and release of clamping engagement between the clamp member and the platform.

* * * * *